United States Patent [19]

Azzerri et al.

[11] Patent Number: 4,886,712

[45] Date of Patent: Dec. 12, 1989

[54] STEEL STRIP FOR FOOD PACKAGING

[75] Inventors: Nazzareno Azzerri, Pomezia; Leonardo Giorgi, Anzio, both of Italy

[73] Assignee: Nuova Italsider S.p.A., Genoa, Italy

[21] Appl. No.: 66,934

[22] Filed: Jun. 26, 1987

[30] Foreign Application Priority Data

Jul. 14, 1986 [IT] Italy ..... 48264 A/86

[51] Int. Cl.[4] ..... B32B 15/04

[52] U.S. Cl. ..... 428/632; 428/666; 428/680; 428/684; 428/469

[58] Field of Search ..... 428/621, 622, 623, 632, 428/648, 666, 680, 684, 469

[56] References Cited

U.S. PATENT DOCUMENTS 4,429,021 1/1984 Higashi et al. ..... 428/648
4,501,802 2/1985 Higuchi et al. ..... 428/648
4,579,786 4/1986 Nakakouji et al. ..... 428/648
4,601,957 7/1986 Fujimoto et al. ..... 428/648
4,713,301 12/1987 Higuchi et al. ..... 428/648

*Primary Examiner*—Upendra Roy
*Assistant Examiner*—George Wyszomierski
*Attorney, Agent, or Firm*—Young & Thompson

[57] ABSTRACT

The suitability of the kind of steel strip known as black plate, optionally coated with small quantities of tin or nickel for food packaging, is greatly improved by ensuring the presence of a layer of P-type semiconducting oxide on the surface thereof.

The quality of the plate is yet further improved by coating the oxide surface with a thin chromic passivation layer that also contains a P-type semiconducting oxide.

7 Claims, No Drawings

STEEL STRIP FOR FOOD PACKAGING

This invention relates to an improved type of steel strip and to the process for the production thereof. More precisely, the invention relates to steel strip for food packaging, endowed with high corrosion resistance, good weldability and excellent lacquer adhesion, while having a far smaller quantity of protective metallic coating than used at the present time.

At the moment, the main material utilized for making food cans is tinplate, essentially because of its good resistance to many of the corrosive elements contained in foods. This corrosion resistance is further improved by the adoption of other protective layers, such as those provided by chromic passivation and/or lacquering.

Tin, however, is considered a strategic metal and is available only in moderate quantities. It is also costly. Other materials have therefore been developed to replace tinplate for making food cans. These materials employ a very small amount of tin compared with that needed for conventional tinplate (2.8–11.2 mg $m^{-2}$), or they may contain none at all.

The most important representatives of this last group ("tin-free steels" as they are called) are those kinds of strip that are covered with a thin layer of chromium and chromium oxide. However, this material has to be lacquered and has welding problems; because with the high melting point of the chromium, the non-conductive nature of the chromium oxide and the high coating weight (total Cr around 100 mg $m^{-2}$) a big increase in welding parameters is needed, the overall result being that the use of tin-free steel is not an economically viable proposition.

The other group of materials, those employing only a thin tin coating, can be broken down into two subgroups. The first of these includes plate where the tin is made to diffuse in the steel so as to form an iron-tin alloy layer on the surface which must, however, be further protected by a heavy layer of chromium and chromium oxide. Corrosion resistance appears satisfactory but, as in the case of the tin-free steels, poor weldability limits use to the bottoms and tops of cans or at least to all those applications where welding is not needed or where the food product is further protected by plastic, paper or other similar types of wrapping.

The second subgroup includes plates where the very thin layer of tin is protected by lacquer. This class of materials is usually more weldable, but corrosion resistance is not satisfactory, mainly because of poor adhesion of the paint to the substrate. Other types of black plate coating such as nickel, zinc-nickel alloys, simple lacquering, etc., have not as yet given satisfactory results.

To sum up, therefore, at the moment there are no materials that can be considered comparable with tin plate as regards reliability, corrosion resistance and weldability, and which are cheaper than those known.

The object of this invention is to overcome this difficulty by providing a plate, and the method of producing it, which is weldable, corrosion resistant, easily made and cheap.

The lacquering solution appears very promising because of the good protection afforded at an acceptable cost; the problem to be resolved, however, is adhesion of the lacquer to the substrate, especially in a moist environment. Lacquering can be considered only if it is capable of impeding contact between the steel and the canned food under all circumstances, preventing dissolution of the metal.

To this end, the interface between the substrate and the lacquer must be appropriately stabilized to ensure that the polymer film is not removed from the steel strip during the severe mechanical deformations that occur during can-making (dry adhesion) and especially that the film remains unbroken, thus isolating the steel from the contents of the can which are generally corrosive in one manner or another (wet adhesion).

The improved steel strip as per this invention resolves the problem of interface stabilization and is characterized by the fact that the surface of the substrate is covered by a thin patina of semiconducting oxide with mainly P-type behaviour.

The ratio of P-type charge-bearing atoms (NA) to N-type atoms (ND) in the semiconducting oxide is preferably higher than 1.2 for the materials as per this invention, namely for uncoated black plate or for plate coated with metal deposits weighing less than 800 mg $m^{-2}$.

It has been found surprisingly that semiconducting oxides with mainly P-type behaviour adhere well to the lacquers; the adherence values are already good around the above indicated value for the NA/ND ratio.

According to this invention the lacquer adhesion of any metal surface can be improved. The materials that have actually been tried are black plate, black plate with a chemical tin flash coating, black plate with an electrolytic tin flash coating and black plate with a chemical nickel flash coating. However, there is nothing to indicate that other products too can not be beneficially treated as per the invention; chemical deposits of manganese exhibit promising qualities, for instance. In this context the term "flash" is henceforth used to indicate a deposit whose weight ranges from 0.1 to 800 mg $m^{-2}$.

Again according to this invention the product already coated with the aforesaid patina of semiconducting oxide with mainly P-type behaviour can be further covered by a chromic passivation layer consisting of a mixture of chromium metal and chromium oxide, the total weight of chromium being less than 10 mg $m^{-2}$. The nature of this chromium oxide is still not entirely clear, so henceforth it will be referred to as $CrO_x nH_2O$.

Conditions for the formation of the P-type semiconducting oxide can vary depending on the type of substrate involved. The weight of tin or nickel coating tried is thus of some importance. In fact with coating weights in excess of 800 mg $m^{-2}$ not only do production costs increase, but it may also become difficult to obtain the desired type of semiconduction in any case, though it can always be achieved. The coating weight is thus limited to a maximum of 800 mg $m^{-2}$ essentially for cost reason.

Furthermore, very light coatings of tin and nickel, especially those obtained chemically, form a Type-P semiconducting oxide patina spontaneously; the weight of these coatings is typically less than 400 mg $m^{-2}$. In the case of uncoated black plate or plate with tin coatings weighing more than 400 mg $m^{-2}$, specific action must be taken to ensure controlled oxidation of the surface. This controlled oxidation can be achieved in an $Na_2Cr_2O_7$ $2H_2O$ or an $NA_2B_4O_7$ $10_2O$ bath. In the first case the bath contains from 20 to 30 $gl^{-1}$ of $Na_2Cr_2O_7$ $2H_2O$, has a pH between 4 and 5 and the temperature is held in the 40° to 60° C. range. The sheet is used as the anode in the solution, with a current density between 0.5 and 2.5 A $dm^{-2}$ for from 1 to 30 s.

This procedure is particularly advantageous when it is intended to have an oxidized tin substrate subsequently coated with Cr and $CrO_xnH_2O$. In fact, there is chromic passivation section on almost all tinning lines; this functions virtually with the same bath as that described for controlled oxidation, the only difference being that in chromic passivation the strip is used as cathode with a charge density, as per the invention, between 4 and 8 Coulomb $dm^{-2}$. It is evident, therefore, how with just a few minor adjustments this invention can be used immediately on all existing tin-plating lines.

When $Na_2B_4O_7$ $10H_2O$ is used, the treatment bath contains from 25 to 55 g $l^{-1}$ of borax, has a pH kept between 6 and 9 by the addition of $H_3BO_3$, and its temperature is held in the 20° to 40° C. range. With this solution, preliminary reduction of the surface of the strip used as cathode is needed. This is done by passing current of between 0.5 and 2.5 A $dm^{-2}$ for from 2 to ≅s. Then immediately afterwards the strip is used as anode in the same solution, current of between 0.5 and 2.5 A $dm^{-2}$ being passed for times ranging from 1 to 30 s.

By means of these procedures, controlled oxidation of the surface of the strip is assured as per this invention, with the formation of a thin patina of mainly P-type semiconducting oxide. At the present state of knowledge neither the nature of the oxide nor the quantity of the deposit are clearly defined, primarily because of the lack of analytical means which could provide reliable indications on the yield of the deposition processes and on the size of such thin deposits.

However, surface electrode capacity measurements made by means of sine-wave signal of amplitude 5 mV and frequency 1 kHz, have permitted effective measurement of the concentration of charge donor atoms (ND) and acceptor atoms (NA) in the surface layers. It ensues from these measurements that a satisfactory NA/ND ratio is always in excess of 1.2 for the materials treated as per the invention.

It should be observed at this point that in the case of tin deposits weighing between 400 and 800 mg $m^{-2}$, namely those requiring specific controlled oxidation treatment, the best results are obtained with an oxidation charge of between 6 and 12 Coulomb $dm^{-2}$. Below these values the oxide covering is probably not continuous, while above these limits the quantity of P-type oxides is insufficient.

Controlled oxidation treatment performed specifically on tin deposits weighing less than 400 mg $m^{-2}$ or on nickel deposits, namely on deposits where, as indicated, spontaneous oxidation mainly of the P-type is obtained, does not seem to exert any improving effect and, indeed, in some instances there is a deterioration in quality.

For the purpose of exemplification, without limiting the invention or claims thereto a more detailed description is provided below.

In the experimentation a solution containing:

from 20 to 36 g $l^{-1}$ of $Sn^{+2}$ (as SnO)

from 150 to 265 g $l^{-1}$ of phenolsulphonic acid up to 6 g $l^{-1}$ of a complexing agent with the trade name DIPHONE up to 1.75 g $l^{-1}$ of a complexing agent with the trade name SULPHONE (both the latter two products being marketed by Yorkshire Chemicals)

was used for both the electrolytic and chemical tinning baths.

Nickel plating was performed in an 0.5–1.5 $NiSO_4$ $7H_2O$ solution at temperatures between 30° and 70° C. and pH in the 4–5 range, dipping time being from 1 to 10 s.

The materials as per this invention have been tested against other materials available on the market. The characteristics of all the products tested are listed in Table 1.

TABLE 1

| | MATERIAL | SYMBOL | TYPE OF DEPOSIT | PASSIVATION LAYER (tot Cr mg $m^{-2}$) |
|---|---|---|---|---|
| 1 | Black plate | BN | — | — |
| 2 | Tinplate | BNS | Sn (2,8 g $m^{-2}$) | — |
| 3 | Passivated tinplate | BNSP | Sn (2,8 g $m^{-2}$) | 4,9 |
| 4 | Chromed strip | TFS | — | 80,6 |
| 5 | Chromed Sn-alloyed strip | ITI | Sn (1 g $m^{-2}$) | 9,3 |
| 6 | Dichromate oxidized black plate | BNOXB | — | — |
| 7 | Tetraborate oxidized black plate | BNOXT | — | — |
| 8 | Sn-stabilized black plate | BNSFL | Sn (0,001–0,80 g $m^{-2}$) | — |
| 9 | Sn-stablized & oxidized black plate | BNSFLOX | Sn (~0,4 g $m^{-2}$) | — |
| 10 | Sn-stabilized (chem.dep.),passivated black plate | BNSFLP | Sn (~0,001 g $m^{-2}$) | 3,2 |
| 11 | Sn-stabilized,oxidized, passivated black plate | BNSFLOXP | Sn (~0,4 g $m^{-2}$) | 3,6 |
| 12 | Ni-stabilized black plate | BNI | Ni | — |
| 13 | Ni-stabilized,oxidized black plate | BNIOX | Ni | — |
| 14 | Ni-stabilized,oxidized, passivated black plate | BNIOXP | Ni | 3,3 |
| 15 | Ni-stabilized, passivated black pl. | BNIP | Ni | 4,6 |

Items 1 to 5 in Table 1 are reference materials in current production. The following ones are those as per this invention, all obtained at pilot scale, except for the lightest of 8 and for 10 which were made on a industrial tin plating line, without using any current in the tinning section, so as to obtain chemically deposited tin.

The quantity of nickel deposited is not indicated because it is not as yet possible to determine it precisely and in a repeatible manner (anyway the weight is between 0.1 and 5 mg $m^{-2}$).

Controlled oxidation was ensured using different quantities of charge at densities of between 0 and 20 Coulomb $dm^{-2}$.

It should be stressed that the nature of the semiconducting oxide, relevant method of formation and the nature of the substrate play a decisive role as regards strip surface quality and hence lacquer adhesion.

It is thus thought that under the conditions as per this invention, chromium and chromium oxide deposition is accompanied by a certain reduction in the tin oxide formed previously, a mixed oxide being obtained which behaves differently from the controlled oxidation deposit. This idea is checked ahead through the examination of some experimental results.

Lacquer adhesion, welding resistance and weldability tests are reported in the following tables compiled for groups of similar products.

TABLE 2

| MATERIAL | SYMBOL | PROTECTION METAL (1st layer) ($g\ m^{-2}$) | CONTROLLED OXIDATION ANODIC CHARGE ($C\ dm^{-2}$) | TOTAL CHROMIUM (2nd layer) ($mg\ m^{-2}$) | NA/ND ratio | WET ADHESION % specimen surface still covered with lacquer: Epoxy phenolic | Organosol | Acrylic | Polyester | CORROSION RESISTANCE (% variation electric capacity) | WELDABILITY (Amps needed) |
|---|---|---|---|---|---|---|---|---|---|---|---|
| Black plate | BN | — | — | — | — | 40 | 50 | 45 | 50 | 1560 | 50 |
| Dichromate oxidized black plate | BNOXB | — | 2 | — | 2,41 | 70 | 60 | 60 | 55 | | |
| | | — | 4 | — | 3,64 | 75 | 70 | 60 | 55 | | |
| | | — | 6 | — | 3,83 | 75 | 80 | 65 | 58 | | |
| | | — | 8 | — | 4,02 | 80 | 85 | 65 | 60 | | |
| | | — | 10 | — | 4,13 | 85 | 85 | 70 | 68 | 940 | 50 |
| | | — | 12 | — | 3,79 | 78 | 80 | 70 | 65 | | |
| | | — | 14 | — | 3,05 | 70 | 65 | 60 | 60 | | |
| | | — | 18 | — | 1,56 | 60 | 60 | 55 | 50 | | |
| Tetraborate oxidized black plate | BNOXT | — | 4 | — | 3,62 | 68 | 65 | 68 | 65 | | |
| | | — | 6 | — | 3,73 | 70 | 68 | 70 | 70 | | |
| | | — | 8 | — | 3,88 | 80 | 80 | 80 | 70 | | |
| | | — | 10 | — | 4,03 | 90 | 95 | 85 | 80 | 850 | 50 |
| | | — | 12 | — | 4,09 | 95 | 95 | 90 | 85 | | |
| | | — | 14 | — | 3,65 | 85 | 80 | 80 | 75 | | |
| | | — | 16 | — | 2,21 | 70 | 65 | 63 | 70 | | |
| | | — | 18 | — | 1,24 | 60 | 50 | 60 | 60 | | |
| | | — | 20 | — | 1,04 | 50 | 45 | 40 | 45 | | |

TABLE 3

| MATERIAL | SYMBOL | PROTECTION METAL (1st layer) ($g\ m^{-2}$) | CONTROLLED OXIDATION ANODIC CHARGE ($C\ dm^{-2}$) | TOTAL CHROMIUM (2nd layer) ($mg\ m^{-2}$) | NA/ND ratio | WET ADHESION % specimen surface still covered with lacquer: Epoxy phenolic | Organosol | Acrylic | Polyester | CORROSION RESISTANCE (% variation electric capacity) | WELDABILITY (Amps needed) |
|---|---|---|---|---|---|---|---|---|---|---|---|
| Tinplate | BNS | 2.8 (Sn) | — | — | 0 | 68 | 40 | 5 | 25 | 500 | 50 |
| Sn-stabilized black plate | BNSFL | 0.8 (Sn) | — | — | 0.20 | 60 | 30 | 15 | 25 | 800 | 50 |
| Sn-stabilized black plate | BNSFL | 0.001 (Sn) | — | — | 2.63 | 80 | 70 | 80 | 80 | 700 | 50 |
| Sn-stabilized and oxidized black plate | BNSFLOX | 0.4 (Sn) | 0 | — | 0.95 | 70 | 15 | 10 | 15 | 420 | 52 |
| | | | 2 | — | 2.38 | 92 | 70 | 82 | 70 | | |
| | | | 4 | — | 2.50 | 94 | 80 | 87 | 84 | | |
| | | | 6 | — | 2.60 | 96 | 90 | 92 | 94 | | |
| | | | 8 | — | 2.90 | 96 | 96 | 95 | 92 | | |
| | | | 10 | — | 2.65 | 94 | 98 | 90 | 88 | | |
| | | | 12 | — | 2.20 | 90 | 93 | 85 | 80 | | |
| | | | 14 | — | 1.45 | 80 | 80 | 75 | 73 | | |
| | | | 16 | — | 1.10 | 70 | 80 | 70 | 65 | | |
| | | | 18 | — | 1.10 | 68 | 80 | 70 | 65 | | |
| | | | 20 | — | 1.00 | 68 | 75 | 65 | 65 | | |
| | | | 50 | — | 0.55 | 70 | 55 | 40 | 45 | | |

TABLE 4

| MATERIAL | SYMBOL | PROTECTION METAL (1st layer) (g $m^{-2}$) | CONTROLLED OXIDATION ANODIC CHARGE (C $dm^{-2}$) | TOTAL CHROMIUM (2nd layer) (mg $m^{-2}$) | NA/ND ratio | WET ADHESION % specimen surface still covered with lacquer: Epoxy phenolic | Organosol | Acrylic | Polyester | CORROSION RESISTANCE (% variation electric capacity) | WELDABILITY (Amps needed) |
|---|---|---|---|---|---|---|---|---|---|---|---|
| Passivated tinplate | BNSP | 2.8 (Sn) | — | 4.9 | 0.13 | 78 | 97 | 92 | 95 | 511 | 50 |
| Passivated | | 2.8 (Sn) | — | 3.8 | 0.03 | 50 | 40 | 15 | 25 | — | 56 |
| Sn-alloyed strip | ITI | 1.0 (Sn) | — | 9.8 | ∞ | 100 | 100 | 100 | 100 | 530 | 73 |
| Electroless Sn-stabilized, passivated black plate | BNSFLP | 0.001 (Sn) | — | 3.2 | 2.76 | 92 | 95 | 90 | 85 | 650 | 55 |
| Sn-stabilized, oxidized, passivated black plate | BNSFLOXP | | 0 | 3.2 | 3.33 | 98 | 100 | 96 | 98 | | |
| | | | 2 | 3.0 | 3.25 | 100 | 100 | 94 | 100 | | |
| | | | 4 | 3.5 | 3.15 | 96 | 95 | 95 | 96 | | |
| | | | 6 | 4.6 | 3.05 | 92 | 90 | 98 | 93 | 421 | 54 |
| | | 0.4 (Sn) | 8 | 4.4 | 3.01 | 93 | 90 | 86 | 90 | | |
| | | | 10 | 4.1 | 2.67 | 90 | 90 | 80 | 90 | | |
| | | | 12 | 4.0 | 1.88 | 86 | 88 | 75 | 85 | | |
| | | | 14 | 3.8 | 1.52 | 83 | 80 | 70 | 75 | | |
| | | | 16 | 3.6 | 1.10 | 75 | 70 | 60 | 76 | | |
| | | | 50 | 3.0 | 0.80 | 60 | 65 | 50 | 50 | | |

TABLE 5

| MATERIAL | SYMBOL | PROTECTION METAL (1st layer) ($g\ m^{-2}$) | CONTROLLED OXIDATION ANODIC CHARGE ($C\ dm^{-2}$) | TOTAL CHROMIUM (2nd layer) ($mg\ m^{-2}$) | NA/ND ratio | WET ADHESION % specimen surface still covered with lacquer | | | | CORROSION RESISTANCE (% variation electric capacity) | WELDABILITY (Amps needed) |
|---|---|---|---|---|---|---|---|---|---|---|---|
| | | | | | | Epoxy phenolic | Organosol | Acrylic | Polyester | | |
| Chromed strip | TFS | — | — | 80.6 | 0.27 | 100 | 100 | 100 | 100 | 420 | >100 |
| Ni-stabilized black plate | BNI | Ni ($3 \cdot 10^{-4}$) | — | — | 2.83 | 98 | 100 | 94 | 99 | 600 | 50 |
| Ni-stabilized,oxidized black plate | BNIOX | Ni($3\text{-}6 \cdot 10^{-4}$) | 2 | — | 2.61 | 97 | 96 | 88 | 99 | 600 | 50 |
| | | | 4 | — | 2.86 | 98 | 98 | 92 | 98 | | |
| | | | 8 | — | 2.85 | 98 | 97 | 91 | 97 | | |
| | | | 12 | — | 2.89 | 98 | 98 | 95 | 97 | | |
| | | | 16 | — | 3.03 | 96 | 97 | 90 | 95 | | |
| Ni-stabilized,oxidized,passivated black plate | BNIOXP | Ni($4\text{-}9 \cdot 10^{-4}$) | 2 | 3.0 | 3.01 | 99 | 100 | 96 | 96 | 300 | 53 |
| | | | 4 | 3.5 | 2.86 | 98 | 100 | 98 | 97 | | |
| | | | 8 | 4.2 | 3.01 | 100 | 100 | 100 | 99 | | |
| | | | 12 | 4.8 | 3.04 | 100 | 100 | 100 | 100 | | |
| | | | 16 | 5.5 | 2.83 | 96 | 100 | 97 | 100 | | |
| Ni-stabilized,passivated black plate | BNIP | Ni($3\text{-}5 \cdot 10^{-4}$) | — | 5.0 | 3.27 | 100 | 99 | 98 | 98 | 320 | 52 |

Lacking any standard methods, the tests indicated in Tables 2 to 5 were performed in the following manner:

Wet adhesion specimen placed in a solution of 0.1 M citric acid at pH 3 and then subjected to cathodic polarization at −2 Vecs; specimen removed from solution, washed and dried; strip of adhesive tape placed firmly on specimen and then pulled off.

Specimen then examined under the QTM (quantitative image analyzer) and qualitative assessment made, in terms of percentage of area from which paint has not disbonded.

Corrosion resistance

As corrosion resistance of these products is intimately bound up with the life of the polymer film, the anticorrosion performance can be assessed by measuring an electrical parameter—capacity —as proposed by S.Okuda & T.Iguchi at the Sixth International Conference on Organic Coatings Science and Technology, Athens, 1980.

The method consists in measuring the surface capacity of lacquered materials over a lengthy period—typically seven days—of immersion in a solution containing 15 g $l^{-1}$ sodium chloride and 15 g $l^{-1}$ citric acid at pH 3. The measurement is made by applying a sine-wave signal of frequency 1 kHz and amplitude 30 mV, then ascertaining the imaginary component of the impedance.

An increase in capacity indicates the onset of degradation of the polymer film, the greater the increase in measured capacity the more serious the degradation.

Weldability

The weldability test consists in measuring the amperage needed to make an electric resistance weld by means of a Soudronic Wima welding head, with 0.8 mm superimposition, 1.8 mm diameter welding wire, pressure 3.5 bar and speed of 50 m $min^{-1}$.

Of course, the higher the current needed to make the weld, the poorer the weldability of the material. Though Tables 2 to 5 are sufficiently clear, a brief commentary will greatly facilitate understanding of the significance of the invention.

Table 2 indicates the behaviour of black plate in the uncoated and oxidized (dichromate and tetraborate) states when treated with the four types of lacquer most commonly used in food packaging. As is evident, treatment as per this invention results in a marked improvement in the quality of the lacquered black plate even in the unoxidized state. However, because the corrosion resistance of the ensuing product falls short of excellent it can best be used for packing dry produce or at least that which is not highly corrosive.

Table 3 indicates the behaviour of tinplate (reference) and of black plate treated as per this invention. As can be seen, tinplate with 2.8 g $m^{-2}$ tin has good corrosion resistance, but moderate or even poor wet adhesion. Black plate with 0.8 $mm^{-2}$ tin not treated as per this invention is of similar or perhaps slightly poorer quality.

When proceeding as per this invention, only one milligram of tin per square meter is needed to improve lacquer adhesion greatly and also to ensure better corrosion resistance. By increasing the tin deposit to 400 mg $m^{-2}$ and introducing controlled oxidation an excellent quality product is obtained. The excellent results achieved even with an anodic oxidation charge of 2 Coulomb $dm^{-2}$ are explained by the fact that at 400 mg $m^{-2}$ tin is still able to form oxide of the desired type spontaneously.

Table 4 concerns passivated tinplate and black plate. As is evident, lacquer adhesion on the usual tinplate (2.8 g $m^{-2}$ tin) is not optimum if the NA/ND ratio is not satisfactory; anyway the higher the ratio the better the adhesion. With the right NA/ND ratio, 1 mg $m^{-2}$ of tin and good passivation with Cr and $CrO_x nH_2O$ suffice to ensure excellent adhesion values. In this case, however, corrosion resistance is not at its best owing to the thinness of the Sn deposit. There is a general all-round improvement with a tin deposit around 0.4 g $m^{-2}$. Here, too, the fact that such thin tin deposits spontaneously form oxides of the type desired as per this invention means that the best results are obtained with anodic oxidation charges that are very low or even nil.

Table 5 concerns materials with deposits other than tin. It is evident that with a chemical deposit of nickel so thin that it cannot be reliably measured and with a total chromium content of from 3 to 6 mg $m^{-2}$, the invention ensures results similar to those given by tin-free steel (TFS) with a good 80 mg $m^{-2}$ chromium deposit.

We claim:

1. A steel strip weldable into cans, said cans having an inner and an outer surface and said strip having a metallic face adapted to form the inner surface of said cans, the improvement wherein said steel strip includes a layer of a semi-conducting oxide exhibiting P-type behavior and wherein said layer of semi-conducting oxide includes P-type charge-bearing atoms (NA) and N-type charge-bearing atoms (ND) and wherein the ratio of NA to ND is greater than 1.2:1.

2. The steel strip of claim 1 wherein said steel strip has a metallic face selected from the group consisting of uncoated steel and steel coated with a metallic deposit weighing less than 800 mg $m^{-2}$.

3. The steel strip of claim 2 wherein said metallic deposit is selected from the group consisting of tin deposits and nickel deposits.

4. The steel strip of claim 2 wherein said layer of semi-conducting oxide is selected from the group consisting of tin oxide and nickel oxide, the weight of said metallic deposit being in the range of 400 to 800 mg $m^{-2}$.

5. The steel strip of claim 1 wherein said steel strip further includes a coating comprised of a mixture of metallic chromium and chromium oxide on said layer of semi-conducting oxide, the total weight of chromium in said coating being less than 10 mg $m^{-2}$.

6. A steel strip weldable into cans, said cans having an inner and an outer surface and said strip having a metallic face adapted to form the inner surface of said cans, the improvement wherein said steel strip includes a layer of a semi-conducting oxide which includes both P-type charge-bearing atoms (NA) and N-type charge-bearing atoms (ND) and wherein the ratio of NA to ND is greater than 1.2:1, said semi-conducting oxide being selected from the group consisting of tin oxide and nickel oxide.

7. The steel strip of claim 6 wherein said steel strip further includes a coating comprised of a mixture of metallic chromium and chromium oxide on said layer of semi-conducting oxide, the total weight of chromium in said coating being less than 10 mg $m^{-2}$.

* * * * *